United States Patent [19]

Kato et al.

[11] Patent Number: 4,476,186

[45] Date of Patent: Oct. 9, 1984

[54] ULTRAFINE FIBER ENTANGLED SHEET AND METHOD OF PRODUCING THE SAME

[75] Inventors: Hiroyasu Kato, Kyoto; Kenkichi Yagi, Otsu, both of Japan

[73] Assignee: Toray Industries, Inc., Tokyo, Japan

[21] Appl. No.: 479,970

[22] Filed: Mar. 29, 1983

[30] Foreign Application Priority Data

Mar. 31, 1982 [JP] Japan ..... 57-51119
May 6, 1982 [JP] Japan ..... 57-74582

[51] Int. Cl.[3] ..... B32B 27/00

[52] U.S. Cl. ..... 428/290; 28/104; 28/112; 156/84; 156/155; 156/148; 156/181; 156/219; 156/305; 428/156; 428/171; 428/289; 428/299; 428/300; 428/904

[58] Field of Search ..... 428/239, 284, 287, 290, 428/297, 298, 299, 300, 302, 303, 904, 156, 171; 28/104; 156/296, 630, 632, 633, 84, 155, 148, 181, 219, 305

[56] References Cited

U.S. PATENT DOCUMENTS 4,145,468 3/1979 Mizoguchi et al. ..... 428/299
4,146,663 3/1979 Ikeda et al. ..... 428/299
4,198,461 4/1980 Heller et al. ..... 428/301

*Primary Examiner*—James J. Bell
*Attorney, Agent, or Firm*—Austin R. Miller

[57] ABSTRACT

An entangled non-woven fabric having a fiber structure which comprises a portion (A) in which ultrafine fiber bundles consisting of ultrafine fibers of a size of not greater than about 0.5 denier are entangled with one another and a portion (B) in which ultrafine fibers to fine bundles of ultrafine fibers branch from the ultrafine fiber bundles and are entangled with one another, and in which portions (A) and (B) are nonuniformly distributed in the direction of fabric thickness. The product of this invention has high flexibility as well as good shape retention.

The invention also relates to a grained sheet having on at least one of its surfaces a grain formed by a fiber structure composed of ultrafine fibers to fine bundles of ultrafine fibers and having a distance between the fiber entangling points of not greater than about 200 microns, and a resin in the gap portions of the fiber structure. The grained sheet of the invention has high flexibility resistance, shearing fatigue resistance and scratch and scuff resistance.

41 Claims, 4 Drawing Figures

ULTRAFINE FIBER ENTANGLED SHEET AND METHOD OF PRODUCING THE SAME

BACKGROUND OF THE INVENTION

1. Field of the Invention

This invention relates to a novel ultrafine fiber entangled sheet and a method for the production thereof. More particularly, the present invention relates to a novel entangled non-woven fabric having a fiber structure which includes a layer comprised of ultrafine fiber bundles that are entangled with one another and a layer comprised of ultrafine fibers to fine bundles of ultrafine fibers wherein both layers are nonuniformly distributed in the direction of fabric thickness, and to a method of producing the entangled non-woven fabric. Further, the present invention relates to a novel grained sheet having a grain composed of densely entangled ultrafine fibers to fine bundles of the ultrafine fibers and resin and to a method of producing the novel grained sheet.

2. Description of the Prior Art

Typical examples of conventional non-woven fabrics include (1) non-woven fabric which is produced by webbing conventional staple fibers into a random web and then needle-punching the web, and (2) non-woven fabric as disclosed in Japanese Patent Publication No. 24699/1969 which has a fiber structure which consists principally of single fibers that are gathered and bundled, and in which the fiber bundles are entangled with one another while maintaining the bundle form. However, since fabric (1) has a fiber structure which is relatively thick and the fibers are individually three-dimensionally entangled with one another, the non-woven fabric has low flexibility and very poor tactile properties. Hence, the commercial value of this non-woven fabric has been considerably limited. Although fabric (2) has higher flexibility than fabric (1), non-woven fabric (2) has extremely low shape retention.

With regard to grained sheets, the grain of conventional synthetic leather consists of a porous or nonporous layer of resin, such as polyurethane elastomer, or of an integral laminate of the porous layer with the nonporous layer. However, synthetic leather having such a grain has various drawbacks such as low feel of integration, a very undesirable rubber-like feel, low crumple resistance, excessively uniform and shallow surface luster, and so forth.

To eliminate these drawbacks, various proposals have been made. These proposals include:

(1) Various fillers, such as fine particles, are added in forming the grain.

(2) Ultrafine fibers are arranged along the surface and combined with a porous material to form the grain. (Japanese Patent Publication No. 40921/1974).

(3) A surface fluff fiber and resin are combined to form the grain.

(4) The surface fibers are melted or dissolved so as to locally bond the fibers and form the grain.

However, method (1) has drawbacks in that the flexibility is reduced and the grain luster of the product is diminished by addition of the filters. Since the product obtained by method (2) has a grain fiber structure in which the ultrafine fibers are arranged along the surface in bundle form, the surface fluffs and peeling develops along the surface of the arrangement of the fiber bundles to cause "loose grain" if the sheet or leather is strongly crumpled or shearing stress is repeatedly applied to the sheet. Where the crumpling, or repeated shearing stress continues, cracks eventually occur on the surface. Moreover, fine unevenness occurs on the surface along the bundles of the ultrafine fibers and degrades the surface appearance. The products obtained by methods (3) or (4) have drawbacks in that the surface cracks relatively easily, severely degrading the appearance, when the sheet is repeatedly bent or shearing stress is repeatedly applied to the sheet.

SUMMARY OF THE INVENTION

It is an object of the present invention to provide a non-woven fabric which eliminates the problems encountered with the prior art products described above and which has high flexibility as well as high shape retention.

It is another object of the present invention to provide a method of producing a non-woven fabric which has high flexibility as well as high shape retention.

It is still another object of the present invention to provide a grained sheet which is free from the problems encountered with the conventional synthetic leather described above and has particularly high flexibility resistance, crumple resistance, shearing fatigue resistance and scratch and scuff resistance.

It is a further object of the present invention to provide a method of producing a grained sheet which has particularly high flexibility resistance, crumple resistance, shearing fatigue resistance and scratch and scuff resistance.

These objects are accomplished by the present invention as described hereinbelow.

First, the present invention provides an entangled non-woven fabric which includes a portion (A) comprised of ultrafine fiber bundles of ultrafine fibers having a size not greater than about 0.5 denier which bundles are entangled with one another, and a portion (B) comprised of ultrafine fibers to fine bundles of ultrafine fibers branching from the ultrafine fiber bundles which ultrafine fibers and fine bundles of ultrafine fibers are entangled with one another, and in which both portions (A) and (B) are nonuniformly distributed in the direction of fabric thickness. The present invention also provides a method of producing such an entangled non-woven fabric.

Second, the present invention provides a grained sheet having on at least one of its surface a grain formed by a composite structure comprised of a fiber structure composed of ultrafine fibers to fine bundles of ultrafine fibers and having a distance between the fiber entangling points not greater than about 200 microns, and a resin in the gap portions of the fiber structure. The present invention also provides a method of producing such a grained sheet.

DESCRIPTION OF THE PREFERRED EMBODIMENTS

The term "ultrafine fiber bundle" as used herein denotes fiber bundle in which a plurality of fibers in staple or filament form are arranged in parallel with one another. The fibers may be all of the same type or a combination of fiber types may be used. The entangled non-woven fabric in accordance with the present invention has a fiber structure including a portion (A) in which the ultrafine fibers are three-dimensionally entangled with one another in bundle form without substantially collapsing the state of arrangement described above and a portion (B) in which ultrafine fibers to fine bundles of ultrafine fibers branched from the ultrafine fiber bundles of portion (A), the fine bundles of ultrafine fibers being thinner than the fiber bundles of portion (A), are densely entangled with one another or with the unbranched fiber bundles extending from the portion (A), and portion (A) and (B) are nonuniformly distributed in the direction of fabric thickness. The fiber that forms the entangled non-woven fabric of the present invention has a fiber structure such that one ultrafine fiber is one of fibers constituting a bundle at some portions of the bundle and branches from the bundle at the other portions of the bundle. Therefore, the ultrafine fiber bundle and the fibers branched from the bundle are not independent.

An entangled non-woven fabric whose entire portion consists of portion (A) is formed by means of the entanglement of the fiber bundles with one another. Accordingly, since the entanglement is not dense and can be easily loosened, the non-woven fabric is extremely likely to undergo deformation and it is difficult for the non-woven fabric to retain its shape particularly in a wet or hydrous state.

In an entangled non-woven fabric whose entire portion consists of portion (B), on the other hand, the entanglement of the fibers of the non-woven fabric as a whole is very dense and mutual restriction of fiber movement occurs so that the non-woven fabric has insufficient flexibility.

The objects of the present invention can be accomplished only when portions (A) and (B) are nonuniformly distributed in the direction of the thickness of the fabric. It is particularly preferred that portion (B) be nonuniformly distributed along the surface portion. Such a non-woven fabric has less fraying of the surface fibers and resists pilling. If the non-woven fabric has a fiber structure in which the ultrafine fibers constituting portions (A) and (B) are substantially continuous and the degree of branching of the fibers in the proximity of the boundary between the portions changes continuously, the non-woven fabric has integral hand characteristics such as flexibility and suppleness and portions (A) and (B) do not peel from one another.

Figure 1:
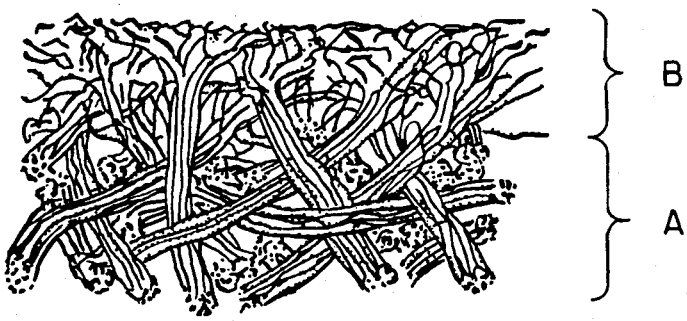
FIG. 1 is a sectional view of a non-woven fabric in accordance with the present invention.
Figure 2A:
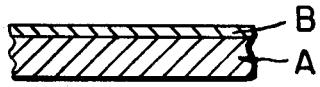
FIGS. 2(*a*) to 2(*g*) are various embodiments of the layers of the non-woven fabric in accordance with the present invention.
Figure 2B:
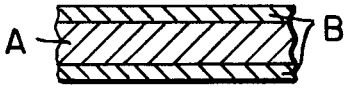
Figure 2C:
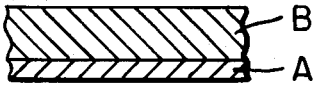
Figure 2D:
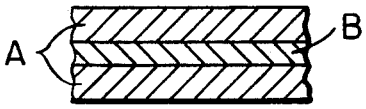
Figure 2E:
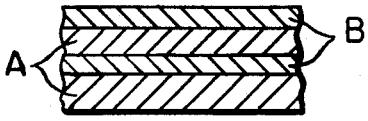
Figure 2F:
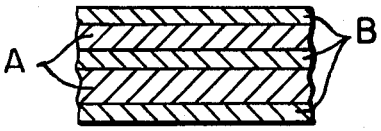
Figure 2G:
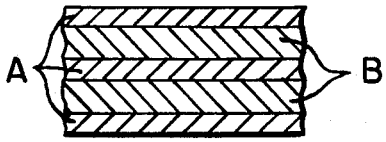

FIG. 1 illustrates an embodiment of the entangled non-woven fabric in accordance with the present invention. In FIG. 1, A denotes the portion in which ultrafine fiber bundles are entangled with one another and B denotes the portion in which ultrafine fibers and fine bundles of ultrafine fibers branch from the ultrafine fiber bundles and are entangled with one another. FIGS. 2(*a*) to 2(*g*) illustrate embodiments in which portions A and B are nonuniformly distributed in the direction of thickness.

The grained sheet in accordance with the present invention is a composite structure whose grain is comprised of ultrafine fibers to fine bundles of ultrafine fibers and of a resin present in the gap portions of the fibers and the fine bundles. The fundamental structure is one in which ultrafine fibers and fine bundles of ultrafine fibers are densely entangled with one another. Only this combination can provide a grained sheet having good hand characteristics such as flexibility and suppleness, smooth surface, high flexibility resistance, shearing fatigue resistance and scratch and scuff resistance.

It is required that the fiber structure in the grain of the grained sheet of the present invention be such that the ultrafine fibers and the fine bundles of the ultrafine fibers densely entangled with one another. In other words, it is necessary that the entanglement density of the fibers be high. One of the methods of measuring the entanglement density of the fibers is to measure the distance between the fiber entanglement points. A short distance between points of entanglement evidences a high density of entanglement.

Figure 3:
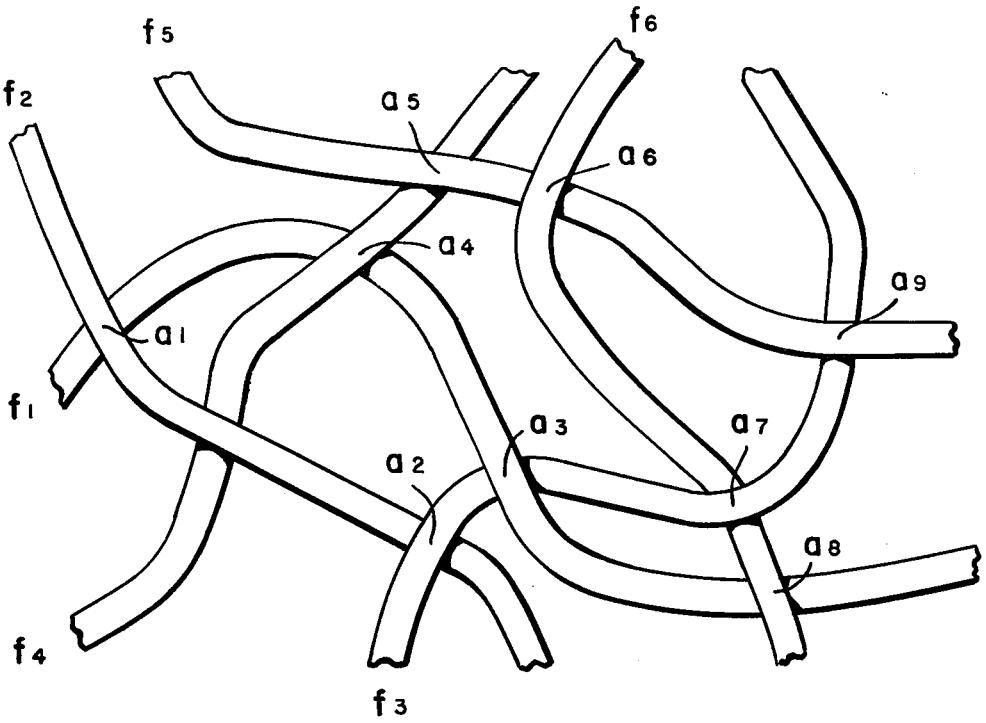
FIG. 3 is a schematic view of entangled constituent fibers of the grain on the surface side of the grained sheet of the present invention.
Figure 4A:
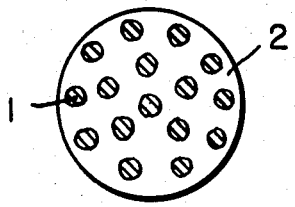
FIGS. 4(*a*) to 4(*o*) are schematic sectional views showing typical examples of fibers which may be used to form the ultrafine fibers employed in the present invention.
Figure 4B:
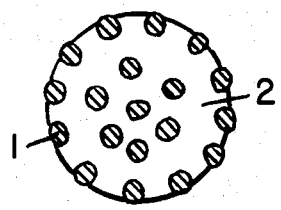
Figure 4C:
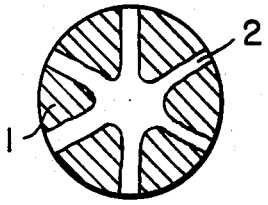
Figure 4D:
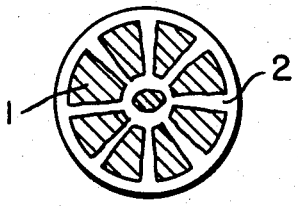
Figure 4E:
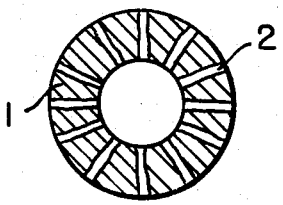
Figure 4F:
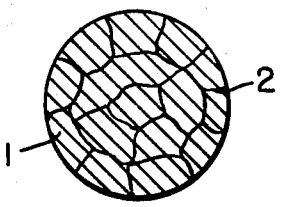
Figure 4G:
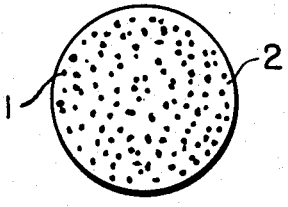
Figure 4H:
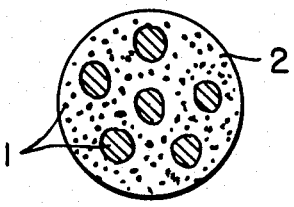
Figure 4I:
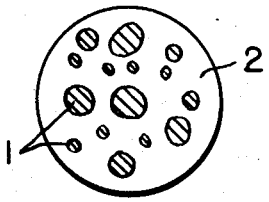
Figure 4J:
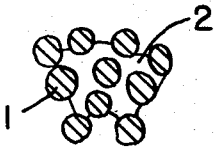
Figure 4K:
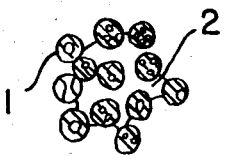
Figure 4L:
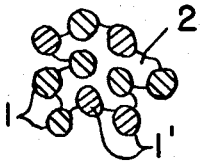
Figure 4M:
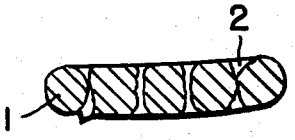
Figure 4N:
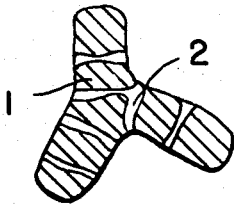
Figure 4O:
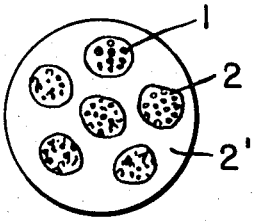

The distance between the fiber entanglement points is measured in the following manner. FIG. 3 is an enlarged schematic view of the constituent fibers in the grain when viewed from the surface side. It will be assumed that the constituent fibers are $f_1, f_2, f_3, \ldots$, the point at which two arbitrary fibers $f_1$ and $f_2$ among them are entangled with each other is $a_1$ and the point at which the upper fiber $f_2$ is entangled with another fiber with the fiber $f_2$ being the lower fiber is $a_2$ (the entanglement point between $f_2$ and $f_3$). Similarly, the entanglement points $a_3, a_4, a_5, \ldots$ are determined. The linear distances $a_1a_2, a_2a_3, a_3a_4, a_4a_5, a_5a_6, a_6a_7, a_7a_3, a_3a_8, a_8a_7, a_7a_9, a_9a_6, \ldots$ measured along the surface are the distance between the fiber entangling points.

In the present invention, the fibers of the grain must have an entanglement density of not greater than about 200 microns as measured by this method. In fiber structures where the entanglement density is greater than about 200 microns, such as in those fiber structures in which the entanglement of the fibers is effected only by needle punching, in which ultrafine fibers or bundles are merely arranged along the surface or, in which thickly raised ultrafine fibers or bundles are laid down on the surface of a substrate to form the grain, little or no entanglement of the fibers occurs. When friction, crumpling and shearing stress are repeatedly applied to such fabrics the surface is likely to fluff unsightly or to develop cracks. To eliminate these problems, the distance between the fiber entangling points must be not greater than 200 microns. More favorable results are obtainable when the distance is not greater than about 100 microns.

There are no specific requirements for the structure of the layer below the grain of the grained sheet in accordance with the present invention and this layer may be suitably constructed in accordance with the intended application. However, the lower layer preferably has the following structure. The lower layer of the grained sheet preferably has a fiber structure in which ultrafine fiber bundles are entangled with one another, ultrafine fibers and the fine bundles of ultrafine fibers of the grain are formed as the ultrafine fiber bundles of the lower layer branch and are densely entangled with one another, the fibers in the grain are substantially continuous with the fibers in the lower layer and, moreover, the degree of branching of the fibers continuously changes at the boundary between both layers. Such a fiber structure provides a sheet having integral hand characteristics and prevents peeling of the grain from the lower layer. In this instance, it is not necessary that the size of the fine bundles of ultrafine fibers of the grain be all the same. If the size of the bundles of the ultrafine fibers of the grain is less than that of the ultrafine fibers of the lower layer, or if the number of fibers contained in one bundle of the grain is smaller than that of the lower layer, unevenness does not easily occur on the surface of the sheet.

In the conventional grained sheet where the substrate or base consists solely of a non-woven fabric, such as is formed solely by needle punching, as the substrate, the sheet is easily extensible upon application or tensional forces and is non-elastically deformed. With such a substrate, a resin must be applied to the substrate to prevent deformation of the grained sheet.

In contrast, the grained sheet of the present invention, having a fiber structure in which the ultrafine fibers and the fine bundles of the ultrafine fibers of the grain are densely entangled with one another, is not seriously deformed under application of in-use tensional forces and has good shape retention even when resin is not applied to the lower layer. This is also one of the most characterizing features of the grained sheet of the present invention. Needless to say, resin such as polyurethane elastomer may be applied to the lower layer and deposition quantity of the resin varies depending upon the application of the sheet. For example, when the sheet is to be used for apparel, the resin deposition quantity is preferably 0 to 80 parts by weight based on the weight of the fibers.

Resins which may be used for the grained sheet are synthetic or natural polymer resins such as polyamide, polyester, polyvinyl chloride, polyacrylate copolymers, polyurethane, neoprene, styrene butadiene copolymers, acrylonitrile/butadiene copolymers, polyamino acids, polyamino acid/polyurethane copolymers, silicone resins and the like. Mixtures of two or more resins may also be used. If necessary, additives such as plasticizers, fillers, stabilizers, pigments, dyes, cross-linking agents, and the like may be further added. Polyurethane elastomeric resin, either alone or mixed with other resins or additives, is preferably used because it provides a grain having particularly good hand characteristics such as flexibility and suppleness, good touch and high flexibility resistance.

The deposition structure of the resin in the grain is dependent on the intended application. Where flexibility and soft touch are required such as in apparel, preferred structures are those in which the resin is applied in a progressively increasing amount towards the surface of the grain. The resin deposition quantity is the greatest in an extremely thin layer on the outermost surface of the grain with little or no resin at other portions. The resin at the surface portion is non-porous, whereas the portion below the surface portion is porous. Where high scratch and scuff resistance are particularly required, a preferred fiber structure is one where the resin is packed substantially fully into the gap portions of the grain without leaving any gaps intact. The grained sheet in accordance with the present invention includes, of course, one in which the outermost surface of the grain consists of a thin resin layer of up to about 30 microns of a resin such as a polyurethane elastomer which is integrated with the other portions.

As the ultrafine fibers to be used in the present invention, there may be mentioned those which are produced by various direct methods, such as super-draw spinning, jet spinning using a gas stream, and so forth. In accordance with these methods, however, spinning would become unstable and difficult if the fiber size becomes too fine. For these reasons, it is preferred to employ the following types of fibers which are formable into ultrafine fiber and to modify them into ultrafine fibers at a suitable stage of the production process. Examples of such ultrafine fiber formable fibers include those having a chrysanthemum-like cross-section in which one component is radially interposed between other components, multi-layered bicomponent type fibers, multi-layered bicomponent type fibers having a doughnut-like cross-section, mixed spun fibers obtained by mixing and spinning at least two components, islands-in-a-sea type fibers which have a fiber structure in which a plurality of ultrafine fibers that are continuous in the direction of the fiber axis are arranged and aggregated and are bounded together by other components to form a fiber, specific islands-in-a-sea fibers which have a fiber structure in which a plurality of extra-ultrafine fibers are arranged and aggregated and are bonded together by other components to form an ultrafine fiber and a plurality of these ultrafine fibers are arranged and aggregated and are bonded together by other components to form a fiber, and so forth. Two or more of these fibers may be mixed or combined.

It is preferable that ultrafine fiber formable fibers having a fiber structure in which a plurality of cores are at least partially bonded by other binding components, because they provide relatively readily ultrafine fibers by applying physical or chemical action to them or by removing only the binding components.

FIGS. 4(*a*) to 4(*o*) show examples of the ultrafine fiber formable fibers which may be used to obtain the ultrafine fibers. In FIGS. 4(*a*) to 4(*o*), reference numerals 1 and 1' represent ultrafine fibers and reference numerals 2 and 2' represent binding components. The ultrafine fibers may be composite fibers consisting of similar polymer materials in kind or different polymer materials in kind. Other types of fibers which may be used include crimped fibers, modified cross-section fibers, hollow fibers, multi-hollow fibers and the like. Further, ultrafine fibers of different kinds may be mixed.

The size of the ultrafine fibers in the entangled non-woven fabric in accordance with the present invention must not be greater than about 0.5 deniers. If the denier is greater than 0.5, the stiffness of the fibers is so great that the resulting non-woven fabric has low flexibility and it is difficult to densely entangle the fibers.

The ultrafine fibers in the grain of the grained sheet of the present invention are preferably not greater than about 0.2 denier. If the fibers are greater than 0.2 deniers, the fiber stiffness is so great that the grain looses flexibility, the surface develops unsightly creases and cracks, surface unevenness is likely to occur upon crumpling of the sheet and it is difficult to form a dense and flexible grain. Only with ultrafine fibers having a size not greater than about 0.2 denier, more preferably, not greater than about 0.05 denier, can a leather-like sheet be obtained which has a grain fiber structure in which the fibers are densely entangled with one another, which has excellent smoothness, which is soft and which is resistance to development of cracks. Multiple-component ultrafine fiber formable fibers, which provide fiber bundles principally comprised of ultrafine fibers having a denier not greater than about 0.2, preferably not greater than about 0.05 denier, and in which at least one component may be dissolved and removed, and preferably employed. Such fibers can provide a grained sheet having particularly excellent hand characteristics, such as flexibility and suppleness, and a smooth surface. Those fibers which have a specific fiber structure in which a plurality of extra-ultrafine fibers are arranged and aggregated and are bonded together by other components to form one ultrafine fiber (primary bundle) and a plurality of these ultrafine fibers are arranged and aggregated and are bonded together by other components to form one fiber (secondary bundle) can be fibrillated extremely finely and entangled densely when they are subjected to high speed fluid jet streams. Hence, such fibers provide a grained sheet having extremely soft and excellent touch.

The ultrafine fibers of the present invention consist of polymer material having fiber formability. Examples of the polymer material include polyamides, such as nylon 6, nylon 66, nylon 12, copolymerized nylon, and the like; polyesters, such as polyethylene terephthalate, polybutylene terephthalate, copolymerized polyethylene terephthalate, copolymerized polybutylene terephthalate, and the like; polyolefins, such as polyethylene, polypropylene, and the like; polyurethane; polyacrylonitrile; vinyl polymers; and so forth. Examples of the binding component of the ultrafine fiber formable fibers, or the component which is to be dissolved for removal, include polystyrene, polyethylene, polypropylene, polyamide, polyurethane, copolymerized polyethylene terephthalate that can be easily dissolved in an alkaline solution, polyvinyl alcohol, copolymerized polyvinyl alcohol, styrene/acrylonitrile copolymers, copolymers of styrene with higher alcohol esters of acrylic acid and/or with higher alcohol esters of methacrylic acid, and the like.

From the aspect of fiber spinnability, as well as dissolvability for removal of the binding component, however, polystyrene, styrene/acrylonitrile copolymers, and copolymers of styrene with higher alcohol esters of acrylic acid and/or with higher alcohol esters of methacrylic acid and preferably used. The copolymers of styrene with higher alcohol esters of acrylic acid and/or with higher alcohol esters of methacrylic acid are further preferably used because during drawing they provide a higher draw ratio and fibers having higher strength.

In order to to easily fibrillate the ultrafine fiber formable fibers it is preferred to mix some amount of heterogeneous substance to the binding component before spinning. Such heterogeneous substance makes easy to break or remove the binding component by treating with high speed fluid jet streams. Thus the ultrafine fiber formable fibers are fibrillated into ultrafine fibers or fine bundles of ultrafine fibers and densely entangled. Examples of the heterogeneous substances include polyalkyleneetherglycols, such as polyethyleneetherglycol, polypropyleneetherglycol, polytetramethyleneetherglycol and the like; substituted polyalkyleneetherglycols such as methoxypolyethyleneetherglycol and the like; block or random copolymers such as block copolymer of ethyleneoxide and propyleneoxide, random copolymer of ethyleneoxide and propyleneoxide, and the like; alkyleneoxide additives of alcohols, acids or esters, such as ethyleneoxide additive of nonylphenol and the like; block copolymers of polyalkyleneethervlycols and other polymers, such as block polyetherester of polyethyleneetherglycol and various polyesters, block polyetheramide of polyethyleneetherglycol and various polyamides; polymers mentioned above as the binding component in combination with different polymer as the binding component; fine particles of inorganic compounds such as calcium carbonate, talc, silica, colloidal silica, clay, titanium oxide, carbon black and the like; mixtures thereof and so forth.

In view of spinnability and effect of fibrillation, organic polymers, especially polyalkyleneetherglycols are preferable. Among these, polyethyleneetherglycol is most effective for fibrillation and dense entanglement. Certain amount of polyethyleneetherglycol helps breaking of a binding component while treating with the high speed fluid jet streams and makes it possible to remove the binding component without dissolving out by a solvent.

Preferable molecular weight range of polyalkyleneetherglycol is 5,000 to 600,000, especially, 5,000 to 100,000 in view of its melt viscosity.

Preferred amount of heterogeneous substance varies according to intended use. In case of polyalkyleneetherglycol, 0.5 to 30 wt%, based on the total amount of binding component, is preferable. 2 to 20 wt% is most preferable. If the amount is under 0.5 wt%, the fibrillation effect is inferior, and if the amount is over 30 wt%, fiber spinnability becomes worse.

There is no limitation, in particular, to the size of the ultrafine fiber formable fibers but the preferred size range is from about 0.5 to 10 denier in view of spinning stability and ease of sheet formation.

The method of producing the entangled non-woven fabric in accordance with the present invention comprises, for example, forming a web by use of fiber bundles which are obtained by bundling ultrafine fibers obtained in the manner described above and temporarily treating them with a binding component to retain the fibers in bundle form, or by use of filaments or staple fibers of ultrafine fiber formable fibers, then optionally needle-punching the resulting web to form an entangled structure and thereafter removing the binding component using a solvent which can dissolve only the binding component. Thereafter, the resulting entangled structure is treated with high speed fluid jet streams so as to branch the ultrafine fibers and the fine bundles of ultrafine fibers from the ultrafine fiber bundles and to simultaneously entangle the branching ultrafine fibers and the fine bundles of ultrafine fibers. A step of applying a paste, such as polyvinyl alcohol, to temporarily fix the non-woven fabric as a whole after the entangled structure is formed by needle-punching, and removing the paste after dissolution and removal of the binding component or simultaneously effecting the high speed fluid jet streams treatment with the removal of the paste, so as to prevent the collapse of the shape of the non-woven fabric at the time of dissolution and removal of the binding component may optionally be used in the process. The treatment with the high speed fluid jet streams may be effected before the binding component is removed.

In some cases, branching of the fibers by treatment with the high speed fluid jet streams is not sufficiently effected because the ultrafine fibers are bonded together by the binding component. In such cases, branching can be accomplished extremely effectively by the following method. A polymer, such as polyethylene glycol, is added to the binding component for the ultrafine fibers or, alternatively a substance that can degrade or plasticize the binding component is applied to the fiber sheet before the treatment with the high speed fluid jet streams.

Examples of a substance that can degrade or plasticize the binding component include degrading agents, solvents, plasticizers and surfactants for such a binding component. Any substance can be used which can cause cracks in the binding components, can change the binding component into a powder, can plasticize or degrade it and can thus reduce the collapse resistance of the binding component at the time of the treatment with the high speed fluid jet streams. For such surfactants, some esters of polyalkyleneetherglycols and carboxylic acids are useful. As polyalkyleneetherglycol, polyethyleneetherglycol, polypropyleneetherglycol, polytetramethyleneetherglycol and copolymer thereof are preferably used. As carboxylic acid, propionic acid, butyric acid, caproic acid, caprylic acid, lauric acid, myristic acid, palmitic acid, stearic acid, and the like, are preferably used.

In order to obtain the structure of the entangled non-woven fabric of the present invention, the apparent density of the non-woven fabric before the treatment with the high speed fluid jet streams is preferably from about 0.1 to 0.6 g/cm$^3$. If the apparent density is below about 0.1 g/cm$^3$, the fibers move easily and those pushed by the fluid jet streams penetrate through the non-woven fabric and intrude into the metal net on which the non-woven fabric is placed, so that severe unevenness appears on the surface of the non-woven fabric. If the apparent density is above about 0.6 g/cm$^3$, the fluid jet streams are reflected on the surface of the non-woven fabric and entanglement is not sufficiently accomplished.

The term "fluid" herein used denotes liquid or a gas and, in some particular cases, may contain an extremely fine solid. Water is most desirable from the aspects of ease in handling, cost and the quantity of fluid collision energy. Depending upon the intended application, various solutions of organic solvents capable of dissolving the binding component, and aqueous solutions of alkali, such as sodium hydroxide, for example, or an aqueous solution of an acid may also be used. These fluids are pressurized and are jetted from orifices having a small aperture diameter or from slits having a small gap in the form of a high speed columnar streams or curtain-like streams.

There is no limitation, in particular, to the shape of the jet nozzle main body, but a transverse nozzle having a number of orifices having a diameter of about 0.01 to 0.5 mm that are aligned with narrow gaps between, in a line or in a plurality of lines can be conveniently used to obtain a fiber sheet having less surface unevenness and uniform properties.

The gap between the adjacent orifices is preferably from about 0.2 to 5 mm in terms of the distance between the centers of these orifices. If the gap is smaller than about 0.2 mm, machining of the orifices becomes difficult and the high speed fluid jet streams are likely to come into contact with streams from adjacent orifices. If the gap is greater than about 5 mm, the surface treatment of the fiber sheet must be carried out many times.

The pressure applied to the fluid varies with the properties of the non-woven fabric and can be freely selected within the range of about 5 to 300 kg/cm$^2$. The high speed fluid jet streams may contact the fiber sheet several times, the pressure for each jet may be varied or the nozzle or non-woven fabric may be oscillated during jetting to optimize fabric properties.

The binding component used for bundling and temporarily bonding the ultrafine fibers are preferably those which can be easily removed by water for industrial economy. Examples of such components are starch, polyvinyl alcohol, methylcellulose, carboxymethylcellulose and the like. Synthetic and natural pastes and adhesives that can be dissolved by solvents can also be used. Examples of such pastes and adhesives are vinyl type latex, polybutadiene type adhesives, polyurethane type adhesives, polyester type adhesives, polyamide type adhesives, and so forth.

In the production of the entangled non-woven fabric in accordance with the present invention, it is not necessary to use wholly ultrafine fibers and a combined use of other fibers may be permitted in so far as it does not diverge from the object of the present invention. It is also possible to incorporate resin binder as well.

The grained sheet in accordance with the present invention may be produced by the following method. The ultrafine fiber formable fibers are first produced by use of a spinning machine such as one disclosed in Japanese Patent Publication No. 18369/1969, for example, and are then converted into staple fiber, and the resulting staple fibers are passed through a card and a cross lapper to form a web. The web is needle-punched to entangle the ultrafine fiber formable fibers and to form a fiber sheet. Alternatively, after the ultrafine fiber formable fibers are spun, they are subsequently stretched and are randomly placed on a metal net. The resulting web is needle-punched in the same way as above to obtain the fiber sheet. Still alternatively, the ultrafine fiber formable fibers are placed on a non-woven fabric, woven fabric or knitted fabric consisting of ordinary fibers or another kind of ultrafine fiber formable fibers and are inseparably entangled to form a fiber sheet. The fiber sheet thus obtained is treated with a high speed fluid jet streams to branch the ultrafine fiber formable fibers into ultrafine fibers to fine bundles of ultrafine fibers and to simultaneously entangle the fibers and their bundles. The treating method used for the production of the entangled non-woven fabric of the present invention described above can also be used for this high speed fluid jet stream treatment. The non-woven fabric of the present invention described hereinabove can also be preferably used for producing the grained sheet of the present invention.

If the ultrafine fiber formable fibers used are of the type which can be modified to ultrafine fiber bundles when part of the components are dissolved and removed, the dissolving and removing step is thereafter applied depending on the intended application. If necessary, the sheet is wet-coagulated of dry-coagulated by impregnating the sheet with a solution or dispersion of a polyurethane elastomer or the like. In this instance, part of the fiber components may be dissolved and removed before the high speed fluid jet stream treatment. Since the ultrafine fiber formable fibers of the sheet are modified into bundles of ultrafine fibers as part of the components are dissolved and removed, the fibers can be highly branched and entangled easily by a low fluid pressure. The high speed fluid jet stream treatment may be effected both before and after the dissolving and removing treatment of the component.

It is further possible to interpose the step of applying the resin between the high speed fluid jet streams treatment and the dissolving and removing step of the component. In this case, it is necessary that the resin should not be dissolved by the solvent used for dissolving and removing the component. Since the component is thus removed, the gaps are defined between the ultrafine fiber bundles and the resin of the resulting fiber sheet and promote freedom of mutual movement of the fibers. Hence, this is a preferred method for providing the resulting sheet with excellent hand characteristics, such as flexibility and suppleness.

On the other hand, application of the high speed fluid jet stream treatment after the application of the resin is not preferable because, if the deposition quantity of the resin is too great, the fibers are restricted by the resin and consequently, branching and entanglement of the fibers and their bundles can not readily be effected. Thereafter, the solution or dispersion of the aforementioned grain resin is applied to the layer of the fiber sheet in which ultrafine fibers to fine bundles of ultrafine fibers are entangled with one another, by suitable methods such as reverse roll coating, gravure coating, knife coating, slit coating, spray coating and the like, is then wet-coagulated or dry-coagulated, is put on the surface of a roller or the surface of the plane sheet and is thereafter pressed and, if necessary, heated so as to integrate the fibers with the resin and to simultaneously flatten the surface.

In this case, it is preferred to make the surface of the fiber sheet flat by heat-pressing the fiber sheet before the application of the grain resin. The use of an embossing roller or a sheet having a grain pattern is preferred because integration, flattening and application of the grain pattern can be simultaneously conducted. If necessary, depending on the final application, coating with a finishing agent, dyeing, crumpling and the like may be carried out.

In using the grained sheet of the present invention for apparel, the following method is preferably employed if flexibility and soft touch are particularly necessary. A substance that can degrade or plasticize the binding component of the ultrafine fiber formable fibers is applied to the fiber sheet consisting of such ultrafine fiber formable fibers and high speed fluid jet stream treatment is then carried out. The resulting fiber sheet is heat-pressed so as to make the surface to which the high speed fluid jet stream treatment is applied smooth. Next, this surface is coated with a resin solution of a polyurethane elastomer or the like and is solidified in such a manner that part of the resin penetrates into the sheet and resin remains as a thin layer on the sheet surface. A grain pattern is then applied using an embossing roller on the sheet surface, if necessary, and after the binding component is dissolved and removed, finishing treatments, such as dyeing, application of softening agents, crumpling and the like are carried out.

The entangled non-woven fabric in accordance with the present invention has high flexibility, retains its shape and has particularly high shape retention when wet such as when the fabric contains a liquid, such as water. Because of these properties, the non-woven fabric can be suitably used for cloths, towels, various filters, materials such as grips, various covers, substrates for synthetic leathers, polishing cloths for furniture, automobiles or glass, polishing pads, cassette tape pads, wiping cloths, and so forth.

The grained sheet in accordance with the present invention has excellent hand characteristics such as flexibility and suppleness, smooth surface touch, high flexibility resistance, high shearing fatigue resistance and high scratch and scuff resistance. For these properties, the grained sheet can be suitably used as grained synthetic leather for apparel, shoe uppers, handbags, bags, belts, gloves, surface leather of balls and the like.

The following examples are intended to further clarify the present invention but are in no way limitative. In the examples which follow, the terms "part or parts" and "%" refer to the "part or parts by weight" and "% by weight" unless otherwise stipulated. The value of the average distance of the fiber entangling points is a mean value of 100 measured values.

EXAMPLE 1

Islands-in-a-sea type fibers (4.5 denier) consisting of 70 parts nylon 6 as the binding component (see component) and 30 parts polyethylene terephthalate containing 0.1% of titanium oxide as the ultrafine fiber component (islands component) were treated with formic acid to continuously dissolve and remove nylon 6. The remaining ultrafine polyethylene terephthalate fibers consisted of 36 filaments of about 0.038 denier. The fibers were then bonded with each other to form fiber bundles by use of a paste consisting of a partial saponified polyvinyl alcohol. A large number of fiber bundles were gathered in a tow, were then passed through a stuffer box type crimper to apply crimp of about 12 crimps/inch without heating and were subsequently cut to form 51 mm staple fibers. The staple fibers were passed through a random webber for random webbing and were needle-punched at a rate of 2,500 needles/cm$^2$ to provide a non-woven fabric having an apparent density of 0.19 g/cm$^3$.

After being pressed by a heated roller to achieve an apparent density of 0.21 g/cm$^3$, the non-woven fabric was placed on a 100 mesh metal net which was being moved and water pressurized to 70 kg/cm$^2$ was jetted from a nozzle having a large number of aligned small apertures and a large number of the columnar streams of the water were jetted to the surface of the non-woven fabric. The treatment was repeated three times for each surface of the non-woven fabric in order to effect dissolution of the paste and, at the same time, branching and entanglement of the fibers. The fabric was then dried. The resulting dried entangled non-woven fabric consisted of ultrafine fibers branching from the portions of about ¼ thickness from both surfaces and of bundles of such ultrafine fibers and had a densely entangled structure. The entangled non-woven fabric had pleasant touch and was soft and not easily deformed.

For comparative purpose, the non-woven fabric having an apparent density of 0.19 g/cm$^3$, which was obtained by only needle punching, was dipped into hot water, whereupon the paste was dissolved and along therewith, the non-woven fabric became easily deformable and difficult to handle. Accordingly, the non-woven fabric was placed on a metal net, was left standing still in hot water for a day and night to dissolve and remove the paste, aand was dried. The resulting non-woven fabric had a structure in which the ultrafine fiber bundles were loosely entangled with one another in bundle form. Though the non-woven fabric was soft, it was remarkably deformed and its surface was unsightly fluffed when it was slightly pulled or rubbed.

EXAMPLE 2

Filaments, each consisting of 16 multi-hollow type ultrafine fibers of nylon 6 of 0.5 denier, were bonded together by a carboxymethylcellulose paste to form a bonded fiber bundle. The crimped fibers were cut to a length of about 38 mm and were thereafter passed through a card and a cross lapper to obtain a web. The web was needle-punched at a rate of 1500 needles/cm$^2$ to obtain a non-woven fabric. The resulting non-woven fabric had an apparent density of 0.15 g/cm$^3$. When it was subjected to treatment with water jet streams under the same conditions as in Example 1, there was obtained an entangled non-woven fabric which was soft and had excellent shape retention. Since this entangled non-woven fabric had extremely high water absorbing characteristics, it was most suitable for various kinds of cloths and towels.

EXAMPLE 3

Islands-in-a-sea type fibers of 3.5 denier, having a composition consisting of 30 parts of a vinyl type polymer, obtained by copolymerizing 20 parts of 2-ethylhexylacrylate and 80 parts of styrene, as the binding component (sea component), and 70 parts of polyethylene terephthalate as the ultrafine fiber component (islands component), and containing 16 ultrafine fibers in one filament. The fibers were crimped and cut to form a web in the same way as in Example 1, followed by needle-punching at a rate of 1500 needle/cm$^2$ to provide a non-woven fabric(1). Alternatively, 3.5 denier specific islands-in-a-sea type fibers having a composition consisting of 45 parts of a mixture of 95 parts of polystyrene and 5 parts of polyethylene glycol, as the binding component (sea component), and 55 parts of polyethylene terephthalate as the extra-ultrafine fibers component (islands component) and containing 16 island component groups in one filament with each island component group containing therein a large number of the extra-ultrafine fibers, were crimped and were cut to 38 mm staple factors. After the resulting web was passed through a card and a cross lapper, it was sprinkled over the non-woven fabric(1) described above for lamination.

Subsequently, needle-punching was effected at a rate of 1500 needles/cm$^2$ from the web side so as to integrate the web with the non-woven fabric(1). The non-woven fabric thus integrated had an apparent density of 0.20 g/cm$^3$. Water which was pressurized to 100 kg/cm$^2$ was jetted to the web side of this integrated non-woven fabric while it was being moved, using the same nozzle as that of Example 1 and this treatment was repeated four times. Thus, the fibers of the laminated web portion were thinly branched and were densely entangled with one another. Next, the non-woven fabric was dipped into trichloroethylene with dipping and wringing repeated so as to extract and remove substantially completely the binding component. Drying was then effected to evaporate and remove the remaining trichloroethylene. The entangled non-woven fabric thus obtained has extremely soft touch and was shape retentive.

EXAMPLE 4

Staple fibers, 51 mm long and 4.0 denier, of islands-in-a-sea type fibers disclosed in Japanese Patent Publication No. 37648/1972 were utilized. The fibers had a composition consisting of 60 parts of vinyl type polymer obtained by copolymerizing 20 parts of 2-ethylhexylacrylate and 80 parts of styrene, as the binding component (sea component), and 40 parts of nylon 6 as the extra-ultrafine fiber component (islands component) and containing 16 island component groups in one filament with each island component group containing therein a large number of the extra-ultrafine fibers. The staple fibers were passed through a card and a cross lapper to from a web. The web was needle-punched using needles having a hook number of 1, so as to entangle the island-in-a-sea tyep fibers and to produce non-woven fabric (A). The non-woven fabric had a weight per unit area of 405 g/m$^2$ and an apparent density of 0.20 g/cm$^3$.

Water which was pressurized to 100 kg/cm$^2$ was jetted and brought into contact at a high speed with the surface of the non-woven fabric (A) while it was being moved, from a nozzle having a line of apertures having a diameter of 0.1 mm and a distance pitch of 0.6 mm between the centers of the apertures. The non-woven fabric was treated five times and ten times under the same conditions, respectively. Next, the pressure of the water was reduced down to 50 kg/cm$^2$ and the same treatment was applied once to the non-woven fabrics while oscillating the nozzle, thereby forming non-woven fabrics (B) and (C), respectively. Each of the resulting non-woven fabrics (B) and (C) had a fiber structure in which the islands-in-a-sea type fibers of the surface layer were branched into ultrafine fibers and into fine bundles of ultrafine fibers and were densely entangled with one another.

Each of the non-woven fabrics (A), (B) and (C) was then impregnated with a 7% dimethylformamide solution of polyurethane prepared by chain-extending a prepolymer between a mixed diol consisting of polyethylene adipate diol and polybutylene adipate diol and p,p'-diphenylmethane diisocyanate using ethylene glycol. After the solution adhering to the surface was removed by a scraper, each non-woven fabric was introduced into water and the polyurethane was coagulated. Thereafter, the non-woven fabric was sufficiently washed in hot water at 80° C. to remove the dimethylformamide. After being dried, the non-woven fabric was repeatedly dipped into trichloroethylene and squeezed to extract the vinyl type polymer sea component of the fibers. After the resin was extracted and removed substantially completely, the non-woven fabric was dried to evaporate and remove the remaining trichloroethylene.

The sheets obtained from the non-woven fabrics (B) and (C) were devoid of unevenness and were extremely smooth on the surface to which the water stream treatment was applied but the sheet obtained from non-woven fabric (A) was found to have unevenness extending along the ultrafine fiber bundles and had low smoothness. Next, a solution which was prepared by adding a pigment to a 10% solution of polyurethane, which had the same composition as that used for impregnation but had considerably higher hardness, was applied to the surface of each sheet by use of a gravure coater. THe sheet was then dried. The treatment using a gravure coater and the treatment of drying were repeated twice. Thereafter, it was passed through a hot embossing roller for pressing to apply a leather-like grain pattern. Thereafter, the sheet was dyed at a normal pressure using a circulating-liquor dyeing machine and was finished in a customary manner.

The grained sheets obtained from the non-woven fabrics (B) and (C) had a smooth surface along the grain pattern, were soft and had integral hand characteristics such as flexibility and suppleness. On the other hand, the sheet obtained from the non-woven fabric (A) exhibited unevenness having vein-like lines extending along the ultrafine fiber bundles and dyeing cracks that extended locally along the ultrafine fiber bundles. The ultrafine fibers appeared at the surface of these cracks.

The polyurethane and finishing agent applied to these grained sheets were extracted and removed by a solvent and the distance between the fiber entangling points were measured. The average distance between the fiber entangling points was 361 microns for the sheet prepared from non-woven fabric (A), 193 microns for the sheet prepared from non-woven fabric (B) and 77 microns for the sheet prepared from non-woven fabric (C).

The flexibility resistance, shearing fatigue resistance and scratch and scuff resistance of these grained sheets were measured according to the following methods:

(1) Flexibility resistance

The degree of damage to the grained surface was judged in accordance with JIS (Japanese Industrial Standard) K 6545-1970.

(2) Shearing fatigue resistance

A 3 cm-wide rectangular testpiece was held by clamps having a clamp gap of 2 cm and stretched by moving one of the clamps parallel to another clamp until a stretch ratio of 25% is reached, then the clamp was moved to the opposite position. This procedure was repeated at a speed of 250 times/min. The degree of damage to the grained surface after 10,000 cycles was judged in accordance with the judging standard described in Item (1) above.

(3) Scratch and scuff resistance

The grained surface was scratched by a needle of 1 mm diameter with a 500 g load using a Clemens scratch tester. The degree of scratch and scuff resistance was judged by the number of scratches required to develop visible damage on the grained surface.

The results are set forth in Table I.

TABLE I

| Non-woven fabric used | Flexibility resistance (1) | Shearing fatigue resistance (2) | Scratch and scuff resistance (3) |
|---|---|---|---|
| (A) | class 2 | class 3 | once |
| (B) | class 4 | class 5 | 4 times |
| (C) | class 5 | class 5 | 4 times |

The test results in Table I demonstrate that the grained sheets produced using non-woven fabrics (B) and (C) of the present invention were superior to the sheet using non-woven fabric (A) in flexibility resistance, shearing fatigue resistance and scratch and scuff resistance.

EXAMPLE 5

A non-woven fabric (A) as prepared in Example 4, was dipped into a 5% aqueous solution of polyvinyl alcohol heated to 95° C. in order to effect impregnation of the polyvinyl alcohol and at the same time to cause shrinkage of the non-woven fabric. The non-woven fabric was dried to remove moisture. Thereafter, the non-woven fabric was repeatedly dipped into trichloroethylene and squeezed to extract and remove the vinyl type polymer sea component of the fiber, followed by drying of the non-woven fabric. The resulting non-woven fabric was one in which the ultrafine fibers were entangled with one another substantially in the form of bundles. Water that was pressurized to 50 kg/cm$^2$ was jetted at high speed to both surfaces of the non-woven fabric using the same nozzle as used in Example 4, and the treatment was repeated three times for each surface at the same conditions so as to dissolve the polyvinyl alcohol and to simultaneously branch and entangle the fibers. The final treatment for each surface was carried out with oscillation of the nozzle. After the polyvinyl alcohol was removed, the non-woven fabric was pressed through a mangle while wet, and was thereafter dried.

The surface layer of the resulting non-woven fabric had a fiber structure in which the original ultrafine fiber bundles were branched to a high degree and were densely entangled with one another. Thereafter, one side on the non-woven fabric was buffed using sand paper and a polyurethane solution was applied to the other surface using a gravure coater with the rest of the subsequent procedures being the same as those in Example 4. There was thus obtained a leather-like sheet.

Although the shape of the resulting grained sheet was substantially fixed only by the entanglement of the fibers, the sheet had excellent shape retention and its fiber structure was highly analogous to that of natural leather. The sheet also had high softness and excellent hand characteristics, such as flexibility and suppleness. When bent ends of the fabric were gripped by fingers, the sheet exhibited round touch and shape, and neither cracking nor fluffing occurred when the sheet was strongly rubbed or pulled by hand. When a coat was tailored from this sheet, it was free from paper-like bent creases and had excellent appearance.

The polyurethane and finishing agent were removed from the grain of this grained sheet using a solvent and the average distance between fiber entangling points were measured. It was found to be 13 microns.

EXAMPLE 6

Islands-in-a-sea type fibers of 3.8 denier and 51 mm long having a composition consisting of 45 parts of a mixture of 95 parts of polystyrene and 5 parts of polyethylene glycol, as the binding component (sea component), and 55 parts of polyethylene terephthalate as the ultrafine fibers component (islands component) and contained 16 ultrafine fibers in one filament were used to produce a non-woven fabric in the same way as in Example 4. The non-woven fabric had a weight of 540 g/m$^2$ and a thickness of 2.8 mm. Columnar streams of water that were pressurized to 70 kg/cm$^2$ were jetted to one surface of the non-woven fabric while it was being moved, using the same nozzle as used in Example 4 and this treatment was carried out five times at the same conditions and twice while the pressure was reduced to 30 kg/cm$^2$. The non-woven fabric was dipped into hot water at 95° C. for the shrinkage treatment and was squeezed by a mangle. The thickness of the resulting entangled non-woven sheet was reduced to about 1.8 mm and the layer of about ½ of the total thickness from the water jet stream treatment surface had a fiber structure in which ultrafine fibers of an average size of about 0.15 denier were branched and the fine bundles of ultrafine fibers were very densely entangled with one another, and the surface of the non-woven fabric had extremely little unevenness.

Using the same impregnation solution comprising a 10% polyurethane solution as used in Example 4, the procedures of impregnation, coagulation, washing with water and drying were carried out in the same way as in Example 4. Next, polystyrene and polyethylene glycol were dissolved and removed using trichloroethylene. After the non-woven fabric was sliced to a thickness of 1.1 mm, a coating prepared by adding carbon black and dyes to the polyurethane solution was applied to the surface layer which was subjected to the water jet stream treatment, using a gravure coater. After the sheet was dried and pressed for integration to produce a composite structure, grain patterning of the composite structure was effected. The opposite surface was buffed to fluff the ultrafine fibers. Next using disperse dyes, the sheet was dyed at a temperature of 120° C. and was then finished in a customary manner. The resulting grained sheet had less repulsive feel but had integral hand characteristics such as flexibility and suppleness, had fluff of relatively long ultrafine fibers on one surface and a grained surface of high quality appearance on the other surface.

When the resulting sheet was used as shoe leather, it provided shoes having a smooth surface which was devoid of so-called "orange peel" that unavoidably occurs at the toe-end of conventional synthetic leather shoes. In comparison with conventional polyurethane-coated shoes, the shoes of this Example were extremely resistant to scratching.

After the polyurethane and finishing agent were removed from the grain of the grained sheet, the average distance between the fiber entangling points was measured. It was found to be 98 microns.

EXAMPLE 7

Specific islands-in-a-sea type fibers consisting of polyethylene terephthalate as the island component and a mixture of polystyrene and polyethylene glycol (molecular weight 20,000) as the sea component (island/sea weight ratio=60/40) and having cross section in which 16 island-in-a-sea type structures, in each of which 8 islands were present in a sea component, were encompassed by one sea component of polystyrene, were spun using an islands-in-a-sea type fiber spinning die disclosed in Japanese Patent Laid-Open No. 125718/1979. The island/total sea ratio of the fibers was 48/52. The yarns thus obtained were stretched to 2.5 times the original length, crimped and cut to provide 3.8 denier, 51 mm long staple fibers. Each island component was an ultrafine fiber of 0.014 denier. The staple fibers were then passed through the steps of opening, carding, cross lapping and needle punching to provide a non-woven fabric. Columnar streams of water pressurized to 150 kg/cm$^2$ were jetted to one surface of the non-woven fabric while it was being moved, from a jet nozzle having apertures having a 0.1 mm diameter and arranged in a line with 0.6 mm gaps there between with oscillating of the nozzle. This treatment was repeated three times and the non-woven fabric was then dried.

Next, an 8% dimethylformamide solution of a polyester type polyurethane was made to permeate, for impregnation, from the side of the non-woven fabric to which the water stream was not applied. After wet coagulation with water, the non-woven fabric was dried. The resulting sheet was pressed by a hot roller so as to smooth the surface which was subjected to the treatment with the water jet stream. A two-pack type polyurethane solution was then applied to the smoothed surface of the sheet using a gravure coater and the sheet was then dried. The deposition quantity of this two-pack type polyurethane was about 3 g/m$^2$. After curing, the surface of the sheet coated with the two-component type polyurethane was embossed at 160° C. using an embossing roller having a leather-like grain pattern.

Thereafter, the sheet was treated with trichloroethylene to remove the sea component of the multi-component fibers. Then, the back of the sheet was buffed by 150 mesh sand paper to fluff the surface and a polyurethane type finishing agent containing a pigment was applied to the grain in a quantity of 2 g/m$^2$ using a gravure coater and was then dyed at 120° C. for one hour using a high temperature dyeing machine while crumpling the sheet. The resulting sheet had grain on one surface and fluff on the other.

The non-woven fabric, after the treatment with the water jet streams, was examined by a scanning electron microscope, and the surface was found to have a fiber structure in which the fibrillated ultrafine fibers and the bundles were entangled with one another. The distance between the fiber entangling points was found to be 85 microns. The portion below the surface was found to have a structure in which a large number of ultrafine fibers were bundled to form primary fiber bundles and the layer further below the former was found to have a fiber structure in which a plurality of the primary fiber bundles described above were further gathered to form an entangled layer consisting principally of secondary fiber bundles. One of the surfaces of the finished sheet had a grain which was composed of the fibrillated fibers and the resin encompassing the fibrillated fibers and was integrated therewith by embossing. It was further observed that the layer of the primary fiber bundles and the porous structure a polyurethane were present below the grain, and the layer of the secondary fiber bundles and the porous structure of polyurethane further continued below the former down to the back of the sheet. The other surface of the sheet was suede-like surface having dense and beautiful fluff and the fluff was seen continuing from the secondary fiber bundles.

The grain of the sheet of the present invention thus obtained had a grain pattern formed by embossing in addition to the crumple pattern due to crumpling of the sheet during dyeing and since they were well mixed, the sheet had high quality surface appearance. The fluff surface of the sheet exhibited graceful appearance like that of the natural suede of deer. Hence, the sheet was suitable as a reversible material. Furthermore, the hand characteristics, such as flexibility and suppleness, were soft and had less repulsive property. Though the sheet was strongly rubbed, no occurrence of surface cracks were observed.

EXAMPLE 8

4.0 denier, 51 mm long staple fibers of specific islands-in-a-sea type fibers having a composition consisting of 60 parts of a vinyl type polymer obtained by copolymerizing 20 parts of 2-ethylhexylacrylate and 80 parts of styrene as the binding component (sea component), and 40 parts of nylon 6 as the extra-ultrafine fiber component (islands component) and containing 16 island component groups in one filament with each island component groups containing further a large number of the extra-ultrafine fibers were passed through a card and a cross lapper to form a web. The average size of the extra-ultrafine fibers was about 0.0003 denier. The web was then needle-punched using needles, each having one hook, so as to entangle the specific island-in-a-sea type fibers with one another and to produce a non-woven fabric. The resulting non-woven fabric had a weight of about 450 g/m$^2$ and an apparent density of 0.18 g/cm$^3$.

The resulting non-woven fabric was then impregnated with a 10% aqueous dispersion of polyethylene glycol (molecular weight 200) monolaurate and was subsequently dried so as to plasticize the vinyl type polymer sea component. A large number of columnar streams of water pressurized to 100 kg/cm$^2$ were jetted once to each surface of the sheet using the same jet nozzle as used in Example 7 while the nozzle was being oscillated, followed by drying of the sheet. Next, the sheet was pressed by a hot roller at 150° C. to smooth the surface treated with the water stream. A 10% solution of polyurethane, to which pigments were added, was applied to the surface by a gravure coater and after the sheet was dried, the leather-like grain pattern was applied to the surface of the sheet using a hot embossing roller.

Thereafter, the sheet was repeatedly dipped into trichloroethylene and squeezed to extract and substantially completely remove the vinyl type polymer sea component of the fiber. The sheet was then dried and was dyed with metal-complex dye using a normal-pressure winch dyeing machine. After a softening agent was applied, the sheet was crumpled and finished.

The resulting leather-like sheet had a weight of 220 g/m$^2$, an apparent density of 0.36 g/cm$^3$, a clear grain pattern and excellent flexibility. When the sheet was strongly crumpled by hand, neither scratching nor damage occurred and the sheet was found to have high flexibility resistance as well as high scratch and scuff resistance. After polyurethane was removed from the grain of the grained sheet, the average distance between the fiber entangling points of the constituent fibers was measured. It was found to be 23 microns.

EXAMPLE 9

3.8 denier, 38 mm long staple fibers of mixed spun fibers obtained by mixing and spinning two components, which have a composition consisting of 45 parts of polystyrene as the binding component, and 55 parts of nylon 6 as the ultrafine fiber component, were passed through a random webber to form a web. The average size of the ultrafine fibers was about 0.002 denier. The web was then needle-punched using needles, each having three hooks, so as to entangle the mixed spun fibers with one another and to produce a non-woven fabric. The resulting non-woven fabric had a weight of about 350 g/m$^2$ and an apparent density of 0.19 g/cm$^3$.

The resulting non-woven fabric was shrunk in a hot water at 97° C. and then pressed through a mangle to squeeze the excess water and dried.

Water that was pressurized to 170 kg/cm$^2$ was jetted at high speed to both surfaces of the non-woven fabric using the same nozzle as used in Example 7 while the nozzle was being oscillated, and the treatment was repeated five times for each surface at the same conditions, followed by drying of the sheet. Next, the sheet was pressed by a hot roller at 150° C. to smooth the surface with the rest of the subsequent procedures being the same as those in Example 8.

The resulting sheet had a weight of 240 g/m$^2$, an apparent density of 0.32 g/cm$^3$, and showed excellent appearance, high softness, and excellent hand characteristics. This sheet developed neither cracking nor fluffing even when the sheet was strongly rubbed or pulled by hand. After polyurethane was removed from the grain of the grained sheet, the average distance between the fiber entangling points of the constituent fibers was measured to be 46 microns.

EXAMPLE 10

2.4 denier, 38 mm long staple fibers of multi-layered bicomponent type fibers having a doughnut-like (as shown in FIG. 4(*e*)) cross-section, which have a composition consisting of 50 parts of polyethylene terephthalate and 50 parts of nylon 66 and have 30 segments, were passed through a random webber to form a web. The average size of each segment was about 0.08 denier. The web was then needle-punched so as to entangle the multi-layered bicomponent type fibers with one another. The resulting needle-punched sheet had a weight of about 460 g/m$^2$ and an apparent density of 0.17 g/cm$^3$.

The resulting needle-punched sheet was shrunk in hot water at 97° C. and then pressed through a mangle to squeeze excess water and dried.

Columnar streams of water pressurized to 150 kg/cm$^2$ were jetted to one surface of the needle-punched sheet while moving the sheet and oscillating the nozzle. The jet nozzle had orifices having a 0.2 mm diameter and arranged in a line with 1.9 mm gaps there between. This treatment was repeated 15 times. After drying, the sheet was pressed by a hot roller at 150° C. to smooth the surface treated with the water streams.

Using an impregnation solution which was prepared by adding pigments to a 8% solution of polyurethane, the procedures of impregnation, coagulation, washing with water and drying were carried out in the same way as in Example 4.

A two-pack type polyurethane solution containing pigments, was then applied to the smoothed surface of the sheet using a reverse roll coater and then dried. The deposition quantity of this two-pack type polyurethane was about 5 g/m$^2$.

Next, a polyurethane solution containing carbon black and dyes was applied, using a gravure coater, to the surface which was treated with the reverse roll coater. After drying and pressing the sheet to produce a dense composite structure, grain patterning of the composite structure was effected. Then the sheet was crumpled.

The resulting grained sheet had integral hand characteristics and a surface of high quality appearance.

When the resulting sheet was used as upper leather of soccer shoes, the shoes show excellent resistance to scratching.

The non-woven fabric, after the treatment with the water jet streams, was examined by a scanning electron microscope, and the surface was found to have a fiber structure in which the fibrillated ultrafine fibers and the bundles were entangled with one another. The distance between the fiber entangling points was found to be 124 microns.

EXAMPLE 11

Islands-in-a-sea type fibers of 3.8 denier, having a composition consisting of 50 parts of polyethylene terephthalate as the ultrafine fiber component (islands component) and 50 parts of the binding component (sea component) consisting of 45 parts of polystyrene and 5 parts of polyethyleneetherglycol of a molecular weight 20,000, and containing 16 ultrafine fibers in one filament, were crimped and cut to a length of about 51 mm, and were thereafter passed through a card and a cross lapper to obtain a web. The web was needle-punched to obtain a non-woven fibrous sheet having a thickness of about 1.0 mm and a weight of about 190 g/m$^2$. The non-woven web was then needle-punched to form a non-woven fibrous sheet having a thickness of about 3.0 mm and a weight of about 540 g/m$^2$.

Water which was pressurized to 110 kg/cm$^2$ was jetted and brought into contact at a high speed to both surfaces of the non-woven fibrous sheet from a nozzle having a line of apertures having a diameter of 0.2 mm and a distance pitch of 1.5 mm between the centers of the apertures, while the nozzle was being oscillated. The treatment was repeated five times for each surface at the same conditions.

The resulting non-woven fibrous sheet was examined by a scanning electron microscope, and it was found that the fibrillated ultrafine fibers were entangled with one another, especially near the surfaces. The non-woven fibrous sheet also had good suppleness and excellent shape retention without dissolving the binding component.

EXAMPLE 12

4.0 denier, 51 mm long staple fibers of mixed spun fibers obtained by mixing and spinning two components which have a composition consisting of 50 parts of nylon 6 as the ultra fiber component, and 50 parts of the binding component comprising 40 parts of copolymer of 2-ethylhexyl acrylate/styrene (20/80) and 10 parts of polyethyleneetherglycol of a molecular weight 50,000 were passed through an opener, a card and a cross lapper to form a web. The web was needle-punched to obtain a needle-punched sheet having a thickness of about 3.0 mm and a weight of about 540 g/m$^2$.

Water which was pressurized to 100 kg/cm$^2$ was jetted to the surface of the needle-punched sheet from a nozzle having a line of apertures of a 0.2 mm diameter and 1.5 mm distance pitch, while the nozzle was being oscillated. The sheet was treated 5 times for each surface at the same conditions.

The jetted sheet was examined by a scanning electron microscope, and it was found that most of the binding components were removed, and the resulting ultrafine fiber bundles consisting of ultrafine fiber of about 0.009 denier were highly fibrillated and the fibrillated ultrafine fibers were densely entangled with one another, especially near the surfaces. The jetted sheet was then impregnated with a 10% emulsion of polyurethane and was dried. Thereafter the sheet was dipped in perchloroethylene and dried. The remaining binding component was easily removed. A leather-like grain pattern was applied to one surface of the dried sheet using a hot embossing roller. The sheet was then dyed red. The dyed sheet showed an extremely dense and smooth surface like that of natural grain leather. Moreover, it had excellent supple touch and flexibility.

We claim:

1. An entangled nonwoven fabric comprising a portion (A) and a portion (B), said portion (A) being comprised of ultrafine fiber bundles, the ultrafine fibers of said bundles having a size not greater than about 0.5 denier, said fiber bundles of said portion (A) being entangled with one another; and said portion (B) comprising either ultrafine fibers or fine bundles of ultrafine fibers or both, each branching from said ultrafine fiber bundles (A), said fine bundles of portion (B) having a size less than said bundles of portion (A);

the ultrafine fibers of said portion (B) being entangled with one another;

said portions (A) and (B) being nonuniformly distributed in the direction of fabric thickness and the degree of branching changing continuously along the boundary portion between said portion (A) and (B).

2. The entangled non-woven fabric as defined in claim 1 wherein said portion (B) is nonuniformly distributed alone one or both surface portions of the fabric.

3. The entangled non-woven fabric as defined in claim 1, wherein said ultrafine fibers forming said portions (A) and (B) are substantially continuous through portions (A) and (B).

4. The entangled non-woven fabric as defined in claim 1 wherein said ultrafine fibers are formed from composite fibers selected from the group consisting of multilayered bicomponent type fibers, chrysanthemum-like cross-section bicomponent fibers, mixed spun multicomponent fibers and islands-in-a-sea type fibers.

5. The entangled non-woven fabric as defined in claim 1 wherein said ultrafine fibers are comprised of a polymer material selected from the group consisting of nylon 6, nylon 66, nylon 12, copolymerized nylon, polyethylene terephthalate, polybutylene terephthalate, copolymerized polyethylene terephthalate, copolymerized polybutylene terephthalate, polyethylene, polypropylene, polyurethane, polyacrylonitrile, vinyl polymers and combinations thereof.

6. A grained sheet having on at least one of its surfaces a grain formed by a composite structure comprising a fiber structure composed of ultrafine fibers or fine bundles of said ultrafine fibers or both and having a distance between the fiber entangling points of not greater than about 200 microns, and a resin in the gap portions of said fiber structure.

7. The grained sheet as defined in claim 6 wherein the lower layer of said grain comprises ultrafine fibers bundles that are entangled with one another, said grain comprises ultrafine fibers to fine bundles of ultrafine fibers branching from said ultrafine fiber bundles of said lower layer, said fibers in said lower layer and in said grain are substantially continuous and the degree of branching of said fibers changes continuously around the boundary portion between said layers.

8. The grain sheet as defined in claim 6 wherein the distance between said fiber entangling points is not greater than about 100 microns.

9. The grained sheet as defined in claim 6 wherein said ultrafine fibers are not greater than about 0.2 denier.

10. The grained sheet as defined in claim 6 wherein said ultrafine fibers are not greater than about 0.05 denier.

11. The grained sheet as defined in claim 6 wherein said ultrafine fibers are formed from composite fibers selected from the group consisting of multilayered bicomponent type fibers, chrysanthemum-like cross-section bicomponent fibers, mixed spun multicomponent fibers and islands-in-a-sea type fibers.

12. The grained sheet as defined in claim 6 wherein said ultrafine fibers are comprised of a polymer material selected from the group consisting of nylon 6, nylon 66, nylon 12, copolymerized nylon, polyethylene terephthalate, polybutylene terephthalate, copolymerized polyethylene terephthalate, copolymerized polybutylene terephthalate, polyethylene, polypropylene, polyurethane, polyacrylonitrile, vinyl polymers and combinations thereof.

13. The grained sheet as defined in claim 6 wherein said resin is selected from synthetic and natural polymer resins.

14. The grained sheet as defined in claim 13 wherein said resin is selected from the group consisting of polyamide, polyester, polyvinyl chloride, polyacrylate copolymers, polyurethane, neoprene, styrene/butadiene copolymers, acrylonitrile/butadiene copolymers, polyamino acids, polyamino acid/polyurethane copolymers, silicone resins and mixtures thereof.

15. The grained sheet as defined in claim 14 wherein said resin is polyurethane.

16. A method of producing an entangled non-woven fabric including a portion (A) comprised of ultrafine fiber bundles entangled with one another and a portion (B), said portion (B) comprising either ultrafine fibers of fine bundles of ultrafine fibers or both, branching from said ultrafine fiber bundles and entangled with one another; said method comprising the steps of:

(1) forming a fiber entangled sheet by use of fibers comprising an ultrafine fiber component and a bonding component which bonds said ultrafine fiber components, arranged in the longitudinal direction of the fibers in an arbitrary cross-section, said components being polymer materials having a different solvent solubility from each other;

(2) dissolving and removing said binding component by use of a solvent which can dissolve said binding component but not said fiber components, and (3) applying a high speed fluid jet stream to said fibers so as to branch and entangle said fibers and to produce a degree of branching continuously along the boundary portion between both portions (A) and (B).

17. The method of producing an entangled non-woven fabric as defined in claim 16 wherein said binding component contains a heterogeneous substance.

18. The method of producing an entangled non-woven fabric as defined in claim 17 wherein said heterogeneous substance is polyalkyleneetherglycol.

19. The method of producing an entangled non-woven fabric as defined in claim 18 wherein said polyalkyleneetherglycol is polyethyleneetherglycol.

20. A method of producing an entangled non-woven fabric including a portion (A) comprised of ultrafine fiber bundles entangled with one another and a portion (B) comprised of ultrafine fibers or fine bundles of ultrafine fiber bundles or both, and entangled with one another, said method comprising the steps of:

(1) forming a fiber sheet by use of fibers comprising an ultrafine fiber component and a bonding component which bonds said ultrafine fiber component, arranged in the longitudinal direction of the fibers in an arbitrary cross-section, said components being polymer materials having a different solvent solubility from each other;

(2) applying high speed fluid jet streams so as to branch and entangle said branched fibers; and (3) dissolving and removing said binding component by use of a solvent which can dissolve said binding components but cannot dissolve said fibers, thus producing a degree of branching changing continuously along the boundary portion between both portions (A) and (B).

21. The method of producing an entangled non-woven fabric as defined in claim 16, further comprising the step of needle-punching said fiber entangled sheet prior to said dissolving and removing step (2).

22. The method of producing an entangled non-woven fabric as defined in claim 16 further including the steps of applying a resin to temporarily fix said fiber entangled sheet prior to said dissolving and removing step (2) and then removing said resin after dissolving and removing said binding component.

23. The method of producing an entangled non-woven fabric as defined in claim 22, wherein said resin removing step and applying high speed fluid jet streams are carried out simultaneously.

24. A method of producing a grained sheet having on at least one of its surfaces a grain formed by a fiber structure composed of ultrafine fibers or fine bundles of said ultrafine fibers or both and having a distance between the fiber entangling points of not greater than about 200 microns, and a resin present in the gap portions of said fiber structure, said method comprising the steps of:

(1) forming a fiber sheet using fibers selected from ultrafine fiber formable fibers and ultrafine fibers;

(2) applying a high speed fluid jet stream to said fiber sheet to branch and entangle said fibers;

(3) applying at least one kind of resin on at least one of its surfaces; and (4) embossing or pressing said applied surface to form a grain.

25. The method of producing a grained sheet as defined in claim 24 wherein said ultrafine fiber formable fibers are those which have a cross-section in which a plurality of cores are at least partially bonded by other components.

26. The method of producing a grained sheet as defined in claim 24 wherein said ultrafine fiber formable fibers are multiple-component fibers which provide fiber bundles of ultrafine fibers not greater than 0.2 denier when at least one of their components is dissolved and removed.

27. The method of producing a grained sheet as defined in claim 26 wherein said ultrafine fibers are not greater than 0.05 denier.

28. The method of producing a grained sheet as defined in claim 24 wherein said ultrafine fiber formable fibers are those which have a fiber structure in which a plurality of extra-ultrafine fibers are aggregated and bonded together by other components to form one ultrafine fiber and a plurality of said ultrafine fibers are aggregated and bonded by other components to form one fiber.

29. The method of producing a grained sheet having on at least one of its surfaces a grain formed by a fiber structure composed of ultrafine fibers to fine bundles of said ultrafine fibers and having a distance between the fiber entangling points of not greater than about 200 microns, and resin present in the gap portions of said fiber structure, as defined in claims 24, 25, 26, 27 or 28 wherein a step of dissolving and removing part of the components of said ultrafine fiber formable fibers by use of a solvent capable of dissolving said part of the components so as to modify said ultrafine fiber formable fibers into a plurality of ultrafine fibers is inserted into the production process of said sheet at a suitable step.

30. A method of producing a grained sheet having on at least one of its surfaces a grain formed by a fiber structure composed of ultrafine fibers or fine bundles of said ultrafine fibers or both, said fibers being tangled at fiber entangling points, and having a distance between the fiber entangling points of not greater than about 200 microns, and said sheet having an applied resin present in the gap portions of said fiber structure, wherein said entangled non-woven fabric as defined in claim 1, 2, or 3 is used as the starting material and resin is applied to at least said portion (B) of said non-woven fabric to form the grain.

31. The method of producing a grained sheet as defined in claim 29 wherein said part of components of said ultrafine fiber formable fibers contains a heterogeneous substance.

32. The method of producing a grained sheet as defined in claim 31 wherein said heterogeneous substance is polyalkyleneetherglycol.

33. The method of producing a grained sheet as defined in claim 32 wherein said polyalkyleneetherglycol is selected from the group consisting of polyethyleneetherglycol and copolymers thereof.

34. The method of providing a grained sheet as defined in claim 24, further comprising the step of heat-pressing said entangled fiber sheet before applying resin.

35. The method of producing a grained sheet as defined in claim 24, further comprising the step of applying a grain pattern on the surface of said resin treated sheet with an embossing roller.

36. The method of producing a grained sheet as defined in claim 25, further comprising the step of dissolving and removing said other components after applying high speed fluid jet streams.

37. The method of producing a grained sheet as defined in claim 25, further comprising the step of dissolving and removing said other components after applying said resin.

38. The method of producing a grained sheet as defined in claim 25, further comprising applying a substance to said sheet to degrade said other component before applying high speed fluid jet streams.

39. The method of producing a grained sheet as defined in claim 24, further comprising crumpling the resin treated sheet.

40. The method of producing the grained sheet as defined in claim 25, further comprising the step of applying a grain pattern on the surface of said resin treated sheet with an embossing roller.

41. The method of producing a grained sheet as defined in claim 40, further comprising the step of dissolving and removing said other components after applying a grained pattern.

* * * * *